US008950965B2

(12) United States Patent
Nagao

(10) Patent No.: US 8,950,965 B2
(45) Date of Patent: Feb. 10, 2015

(54) WRITING INSTRUMENT

(76) Inventor: Takafumi Nagao, Osaka (JP)

( * ) Notice: Subject to any disclaimer, the term of this patent is extended or adjusted under 35 U.S.C. 154(b) by 386 days.

(21) Appl. No.: 13/449,324

(22) Filed: Apr. 18, 2012

(65) Prior Publication Data

US 2012/0275842 A1 Nov. 1, 2012

(30) Foreign Application Priority Data

Apr. 27, 2011 (JP) ..... 2011-100003

(51) Int. Cl.
*B43K 29/00* (2006.01)

(52) U.S. Cl.
USPC ..... 401/195

(58) Field of Classification Search
USPC ..... 401/195, 88, 96, 97; 29/428
See application file for complete search history.

(56) References Cited

U.S. PATENT DOCUMENTS 4,508,464 A * 4/1985 Money ..... 401/6
4,568,213 A * 2/1986 Money ..... 401/6
5,061,104 A * 10/1991 Florjancic ..... 401/195
5,988,918 A * 11/1999 Johnson ..... 401/88

FOREIGN PATENT DOCUMENTS

JP 2003-48395 2/2003

* cited by examiner

*Primary Examiner* — David Walczak
*Assistant Examiner* — Jennifer C Chiang

(57) ABSTRACT

The writing instrument is equipped with the foldable boarding including plural boards foldably connected through the predetermined hinge part and other hinge parts and is capable of transforming between the flat form and the tridimensional form. As for the writing instrument like this, in the flat form, the foldable boarding doubled up along the predetermined hinge part forms a plate-like shape together with the holder which holds the writing unit. On the other hand, in the tridimensional form, the foldable boarding folded along the other hinge parts covers both principal surfaces of the holder to form a prismatic penholder by moving the predetermined hinge part to the vicinity of the specific side surface of the holder. Consequently, the writing instrument is capable of transforming from the flat form to the tridimensional form which gives a good grip feeling.

2 Claims, 9 Drawing Sheets

WRITING INSTRUMENT

This application is based on Japanese Patent Application No. 2011-100003 filed on Apr. 27, the contents of which are hereby incorporated by reference.

BACKGROUND OF THE INVENTION

1. Field of the Invention

This invention relates to a technique of a writing instrument capable of transforming between a flat form and a tridimensional form.

2. Description of the Background Art

A writing instrument such as a ballpoint pen with a rod-like form is widely prevalent. Therefore, a writing instrument capable of transforming from a flat form like a card is desired in light of portability.

About such a writing instrument, there is a technology disclosed in, for example, Japanese Unexamined Patent Publication No. 2003-48395. This technology enables to certainly grip the writing instrument by folding down the rectangular card so that the ballpoint pen core fixed along the diagonal line is sandwiched and inserting a figure into the through-hole provided in the card at the time of the writing.

However, according to the above technology, the thickness becomes only approximately doubled even though the thin card is folded down, and it is difficult to get a good grip feeling which is equivalent to a writing instrument having a rod-like tridimensional form.

SUMMARY OF THE INVENTION

The present invention is directed to a writing instrument which is equipped with a writing unit.

According to the present invention, the writing instrument comprises: a holder which holds the writing unit and has a plate-like shape; and a transformation part which is capable of transforming between a flat form and a tridimensional form and is equipped with a foldable boarding including a plurality of boards foldably connected through a predetermined hinge part and other hinge parts, the foldable boarding being equipped with a looped structure in which one end part and another end part of the foldable boarding are foldably connected to a specific side surface of the holder, the foldable boarding which is doubled up along the predetermined hinge part forming a plate-like shape together with the holder in the flat form, the foldable boarding which is folded along the other hinge parts covering both principal surfaces of the holder to form a prismatic penholder in the tridimensional form by moving the predetermined hinge part to a vicinity of the specific side surface. Consequently, the writing instrument is capable of transforming from the flat form to the tridimensional form which gives a good grip feeling.

According to a preferred embodiment of the present invention, in the tridimensional form, specific boards of the plurality of boards are folded with standing up with respect to a principal surface of the holder. Therefore, the tridimensional form can be stably maintained in a simple structure.

The present invention is also directed to a manufacturing method of a writing instrument which is equipped with a writing unit.

It is therefore an object of the present invention to provide a technique of a writing instrument capable of transforming from a flat form to a tridimensional form which gives a good grip feeling.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Principal Construction of Writing Instrument

Figure 1:
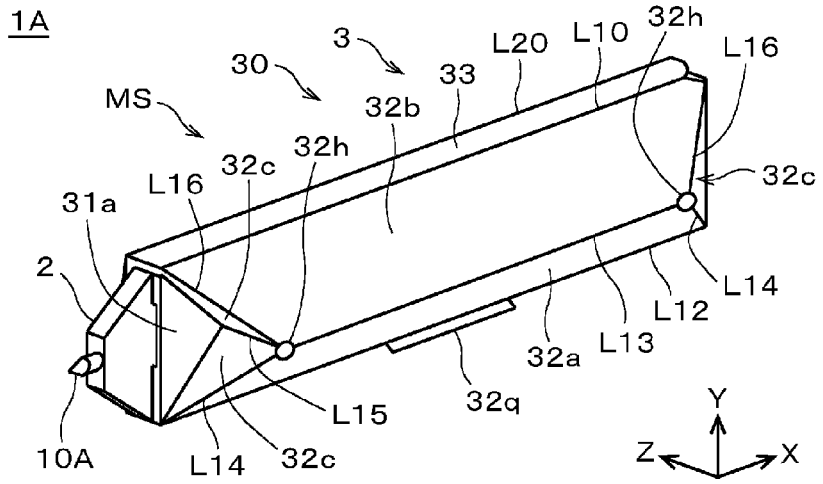
FIG. 1 is a perspective view showing the principal construction of the writing instrument concerning the first preferred embodiment of this invention.

FIG. 1 is a perspective view showing the principal construction of the writing instrument 1A concerning the first preferred embodiment of this invention. Here and in subsequent figures, in order to clarify directional relations, the XYZ orthogonal coordinate system is attached if needed.

The writing instrument 1A is equipped with the writing unit 10A used for writing, the holder 2 which holds the writing unit 10A, and the transformation part 3 for covering around the holder 2 in the tridimensional form MS.

The writing unit 10A has a cylindrical outer shape with a pointed tip, and is constituted as, for example, a core of a ballpoint pen.

The holder 2 and the transformation part 3 have a certain strength enough not to bend easily, and are formed from a material capable of tolerating repetitively folding along the hinge parts indicated by the below-mentioned hinge lines, for example, a plastic (synthetic resin) material such as polypropylene. In addition, it is not indispensable to form the holder 2 or transformation part 3 from a single material. It may be formed from composite materials based on, for example, a material which is capable of tolerating repetitively folding and is located in the superficial layer portion used as the hinge parts, and a different one which is located in the other portion (underlying layer portion).

The transformation part 3 is equipped with the construction capable of transforming from the plate-like flat form to the tridimensional form MS shown in FIG. 1. The constructions of the transformation part 3 and the holder 2 are explained below through the use of FIG. 2 and FIG. 3.

Figure 2:
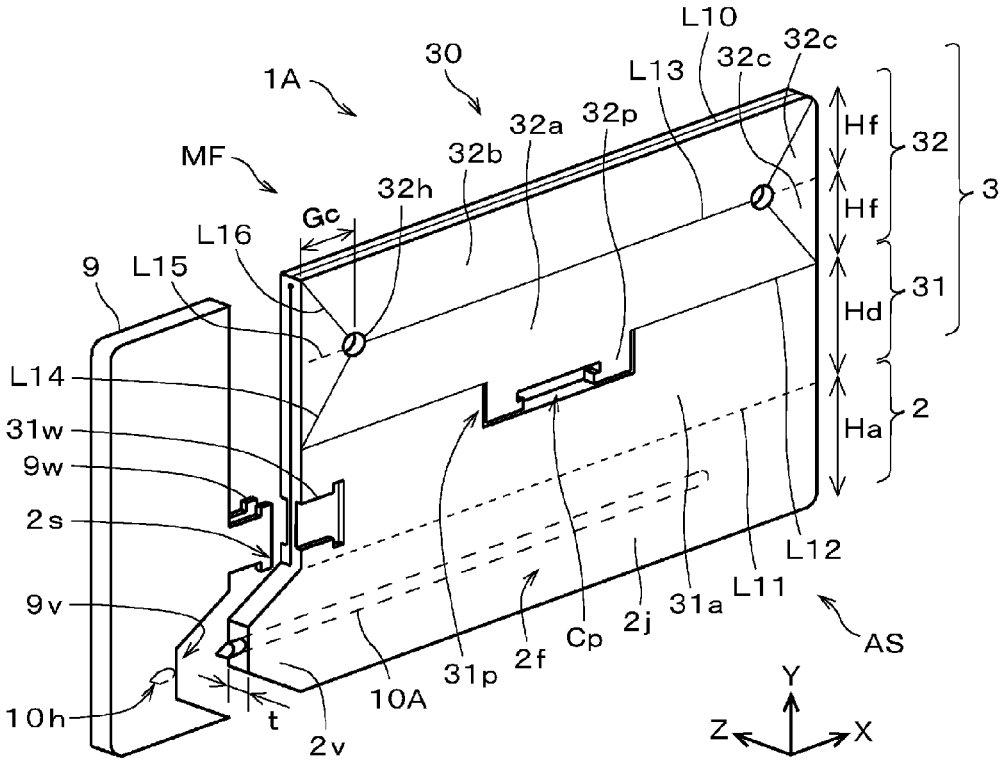
FIG. 2 and FIG. 3 are perspective views showing the appearance of the writing instrument of the flat form.
Figure 3:
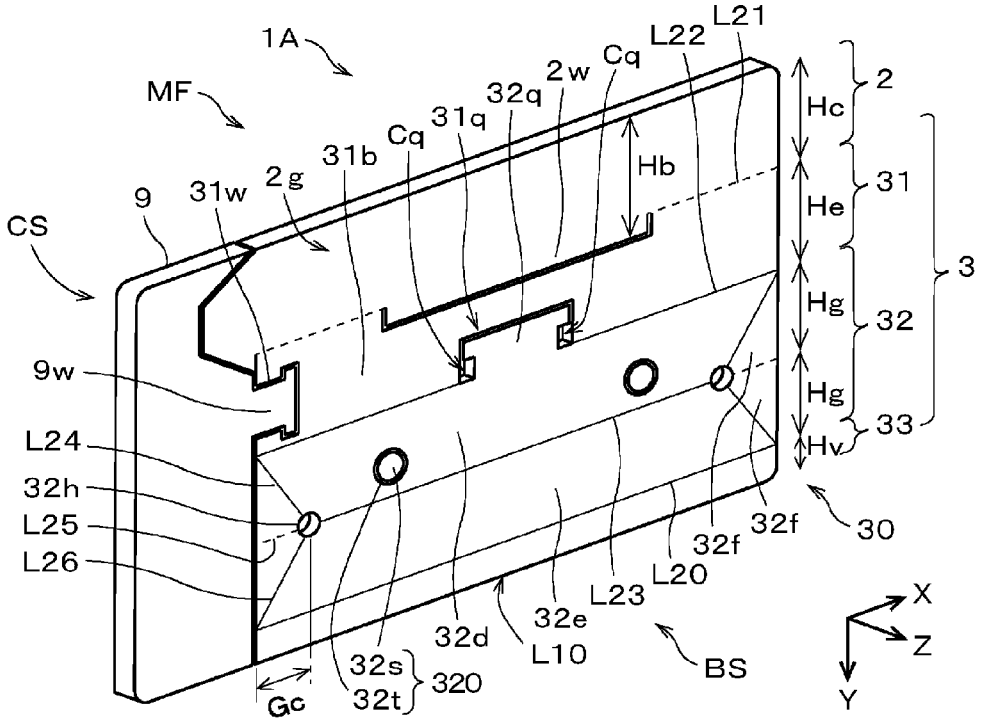

FIG. 2 and FIG. 3 are perspective views showing the appearance of the writing instrument 1A of the flat form MF. FIG. 2 and FIG. 3 mainly show the front surface AS and the back surface BS of the writing instrument 1A, which are illustrated together with the accessory 9 functioned as a cap for protecting a pen nib of the writing unit 10A.

The holder 2 has a plate-like shape with the thickness t. The writing unit 10A is sandwiched between two principal surfaces of the front principal surface 2*f* and the rear principal surface 2*g*, and is fixed inside the holder 2 (refer to FIG. 2). By disposing the writing unit 10A on the central line with respect to the direction (the Y direction) of the width Ha concerning the holder 2 as shown in FIG. 2, the pen nib is not significantly eccentric from the central axis of the penholder body in the writing instrument 1A of the tridimensional form MS (refer to FIG. 1). This enables to get a good writing feeling which is equivalent to a popular writing instrument.

The holder 2 is equipped with the rectangle-like main body part 2*j* connected to the transformation part 3 through the hinge lines L11 and L21, and the trapezoid-like projection part 2*v* projected in the −X direction from the main body part 2*j*. This projection part 2*v* prevents the visual recognition of the pen nib of the writing unit 10A from becoming difficult by being hidden behind the transformation part 3 of the tridimensional form MS shown in FIG. 1. And, the projection part 2*v* has a role in which the potions except the pen nib are kept from contacting a writing object such as paper even though the writing instrument 1A inclines to some extent with respect to the writing object. In addition, as for the accessory 9 having the thickness which is equivalent to the thickness t of the holder 2, the hole 10*h* to insert the pen nib of the writing unit 10A is provided in the trapezoid-like cutout portion 9*v* corresponding to the projection part 2*v*.

The front surface AS of the main body part 2*j* in the holder 2 has a rectangle-like shape with the width Ha. On the other hand, the back surface BS of the main body part 2*j* has a shape in which the rectangle-like convex part 2*w* projected from the straight line concerning the hinge line L21 is added to the rectangle-like base part having the width Hc in the center of the end part located on the side (the side of the +Y direction) of the reversal part 31. The width Hb concerning the Y direction of the holder 2 including the convex part 2*w* is equal to the width Ha concerning the front surface AS of the holder 2. Moreover, the difference between the width Hc concerning the hinge line L21 and the width Hb concerning the convex part 2*w* in the back surface BS of the holder 2 corresponds to half of the width Hv of the below-mentioned adjustment board 33, i.e., the thickness t of the holder 2. In addition, the concave part (cutout part) corresponding to the convex part 2*w* is provided in the below-mentioned rear inversion board 31*b* (refer to FIG. 3).

The transformation part 3 is equipped with the foldable boarding 30 in which the below-mentioned boards are foldably connected through the hinge parts and which is annularly-linked to and extended from the side surface 2*s* of the holder 2. In the transformation part 3, the reversal part 31, the roof part 32 and the adjustment board 33 are provided in order of nearness from the holder 2. In addition, the thickness of each board to constitute the foldable boarding 30 corresponds to, for example, half of the thickness t of the holder 2.

The reversal part 31 is equipped with the plate-like front inversion board 31*a* and rear inversion board 31*b* which are inverted 180 degrees around the hinge line L11 and the hinge line L21 when the writing instrument 1A transforms from the flat form MF to the tridimensional form MS. The width Hd of the front inversion board 31*a* which is sandwiched between the hinge line L11 and the hinge line L12 is equal to the width Ha of the front principal surface 2*f* of the holder 2. And, the width He of the rear inversion board 31*b* which is sandwiched between the hinge line L21 and the hinge line L22 is equal to the width Hc of the rear principal surface 2*g* of the holder 2. This makes the hinge lines L12 and L22 located in the vicinity of the edge portion concerning the −Y direction of the holder 2 as shown in FIG. 6 when the front inversion board 31*a* and the rear inversion board 31*b* are inverted in the tridimensional form MS.

The recessed portions 31*w* engageable to two arm parts 9*w* which are provided in the accessory 9 and have a "T" character-like shape with a certain elasticity are formed in the front inversion board 31*a* and the rear inversion board 31*b*. By fitting the arm part 9*w* of the accessory 9 into the recessed portion 31*w*, the accessory 9 is connected to the writing instrument 1A of the flat form MF to form the card shape CS with, for example, a business card size as a whole as shown in FIG. 3. In light of storing the card in the wallet etc., it is desirable for the thickness of the card shape CS (the thickness t of the holder 2) to be 2 mm or less, and more desirable for it to be 1.5 mm or less.

As for the front inversion board 31*a* and the rear inversion board 31*b*, the rectangle-like cutout portion 31*p* and the cutout portion 31*q* are formed in the centers of the end parts located on the side (the side of the +Y direction) of the roof part 32.

The roof part 32 is a part for forming a gable roof-like shape above the front principal surface 2*f* and the rear principal surface 2*g* of the holder 2 to form the outer shape of the penholder in the writing instrument 1A of the tridimensional form MS. The front surface AS of the roof part 32 is equipped with two trapezoid-like front roof boards 32*a* and 32*b* and four right triangle-like front upright boards 32*c* which are divided by the hinge lines L13 to L16. The back surface BS of the roof part 32 is equipped with two trapezoid-like rear roof boards 32*d* and 32*e* and four right triangle-like rear upright boards 32*f* which are divided by the hinge lines L23 to L26. The front roof extension part 32*p* projected from the straight line concerning the hinge line L12 in the center of the end part located on the side (the side of the −Y direction) of the reversal part 31 is provided in the front roof board 32*a*. And, the rear roof extension part 32*q* projected from the straight line concerning the hinge line L22 in the center of the end part located on the side (the side of the −Y direction) of the reversal part 31 is provided in the rear roof board 32*d*. The front roof extension part 32*p* has a shape in which the "T" character-like cutout portion Cp is removed from the rectangle-like area corresponding to the cutout portion 31*p* of the front inversion board 31*a* in the center of the end part located on the side of the −Y direction. The rear roof extension part 32*q* has a "T" character-like shape in which two rectangle-like cutout portions Cq are removed from the rectangle-like area corresponding to the cutout portion 31*q* of the rear inversion board 31*b* in both sides of the end part located on the side of the +Y direction. The front roof extension part 32*p* and the rear roof extension part 32*q* have a certain elasticity, and can connect to each other by the engagement between the cutout portion Cp and the cutout portion Cq. Therefore, when the front roof extension part 32*p* is connected to the rear roof extension part 32*q*, the state in which the transformation part 3 covers the holder 2 is maintained to enable to keep the tridimensional form MS (refer to FIG. 6).

In the roof part 32, two circular holes 32*t* are formed in the back surface BS of the rear roof board 32*d*. The cylindrical projections 32*s* capable of fitting into and locking the holes 32*t* are provided on the reverse side of the front roof board 32*a* (refer to FIG. 7). Since the projection 32*s* and the hole 32*t* like these serve as the locking part 320 to unlockably lock the interior (inside) portions of the foldable boarding 30, the flat form MF can be kept simply. That is, when the locking is performed through the use of the locking part 320 for maintaining the state in which the portions mutually facing in the foldable boarding 30 of the twofold state are close to each other, the flat form MF of the transformation part 3 (the writing instrument 1A) can be kept easily. On the other hand, when this locking is released, there becomes the state in which the transformation part 3 can become tridimensional.

In the roof part 32, the circular holes 32*h* are formed at the points where the hinge line L13 and the hinge lines L14 to L16 cross and at the points where the hinge line L23 and the hinge lines L24 to L26 cross. The reason for providing holes 32*h* like these is that, if the mountain fold hinge lines L13 and L23 were close (or connected) to the valley fold hinge lines L15 and L25 in the absence of the holes 32*h*, there is a possibility that the stress, such as shearing force, due to folding in the opposite direction may occur at the above close (or connected) places to cause the deformation or breakage, etc. of the roof part 32.

As for the roof part 32, the front roof boards 32*a* and 32*b* have the equal width Hf, and the rear roof boards 32*d* and 32*e* have the equal width Hg. The width Hf concerning the front roof boards 32*a* and 32*b* is equal to the width Hg concerning the rear roof boards 32*d* and 32*e*. This width Hf (Hg) multiplied by the square root of 2 equals the width Ha of the holder 2. Each length Gc of the hinge lines L15 and L25 concerning the front upright board 32*c* and the rear upright board 32*f* (to be exact, each length of the hinge lines L15 and L25 extended to the points where the hinge line L14 and L24 and the hinge lines L16 and L26 cross) is equivalent to, for example, half of the width Ha of the holder 2.

By the relationship of the above widths Ha, Hf and Hg and length Gc, the roof part 32 of the tridimensional form is formed as a triangular prism-like form having a similar isosceles right triangle-like cross-section (with the relationship of mirror symmetry about the XY plane) on each of the front principal surface 2*f* (front inversion board 31*a*) and the rear principal surface 2*g* (rear inversion board 31*b*) of the holder 2 as shown in FIG. 1.

The adjustment board 33 with a slender rectangular plate-like shape is sandwiched between the hinge line L20 and the hinge line (hereinafter referred to as "farthest hinge line") L10 which is located at the edge of the roof part 32 and is furthest from the holder 2 in the flat form MF. The adjustment board 33 is what adjusts (deals with) the gap between the front and rear sides of the roof part 32 which separate along the Z direction in the tridimensional form MS (refer to FIG. 6). The adjustment board 33 has the thickness corresponding to this gap, i.e., the width Hv equal to the sum of the thickness t of the holder 2 and the thicknesses of the front inversion board 31*a* and the rear inversion board 31*b*.

The transformation part 3 having the above construction is equipped with the foldable boarding 30 consisting of the above-mentioned plural boards foldably connected through the farthest hinge line (predetermined hinge line) L10 and the other hinge lines L11 to L16 and L20 to L26. The transformation part 3 can transform between the flat form MF formed by folding along the farthest hinge line L10 and the tridimensional form MS formed by folding along the other plural hinge lines L11 to L16 and L20 to L26.

Therefore, as for the writing instrument 1A, when the valley folds are done along the hinge lines L11 and L15 and the hinge lines L21 and L25 (dashed line part) and the mountain folds are done along the hinge lines L12 to L14 and L16 and the hinge lines L20, L22 to L24 and L26 (solid line part) with respect to the planes of the papers showing FIG. 2 and FIG. 3 after the locking of the locking part 320 is released in the flat form MF, it becomes possible to transform to the tridimensional form MS (refer to FIG. 1). In addition, it is desirable to perform the processing for, for example, developing a fold habit in the making of the writing instrument 1A in order to guide the folding direction concerning the mountain fold and the valley fold. Next, the transformational operation of the writing instrument 1A is explained in detail through the use of FIGS. 4A, 4B, 5A, 5B, 6A and 6B.

Transformational Operation of Writing Instrument 1A

Figure 4A:
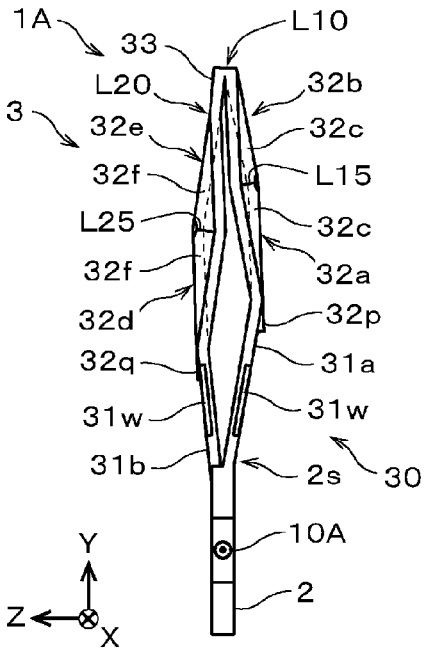
FIG. 4A and FIG. 4B are views for explaining the transformational operation of the writing instrument.
Figure 4B:
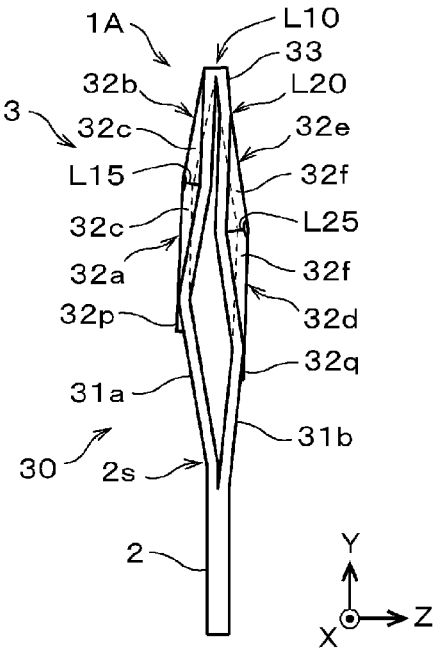
Figure 5A:
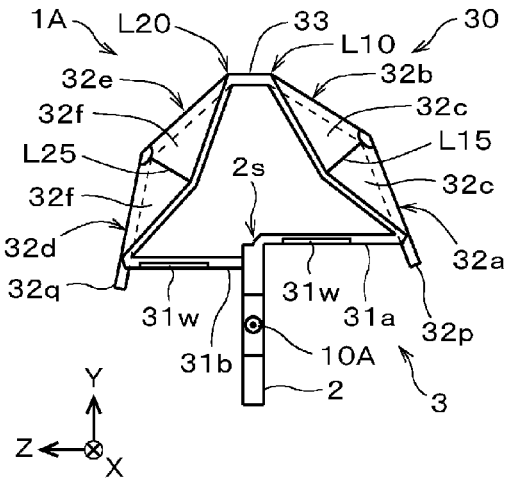
FIG. 5A and FIG. 5B are views for explaining the transformational operation of the writing instrument.
Figure 5B:
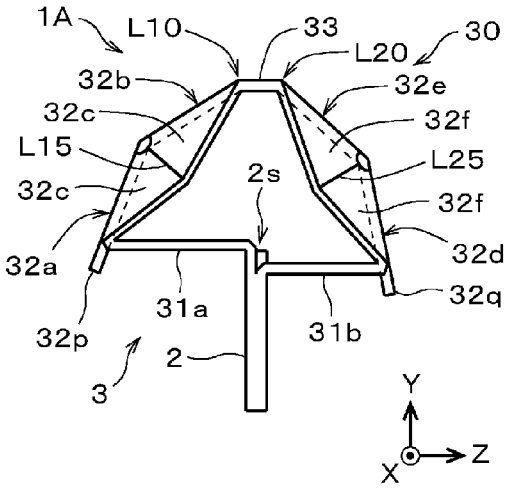
Figure 6A:
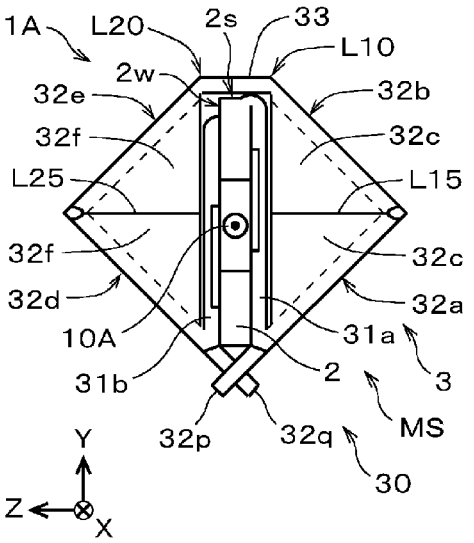
FIG. 6A and FIG. 6B are views for explaining the transformational operation of the writing instrument.
Figure 6B:
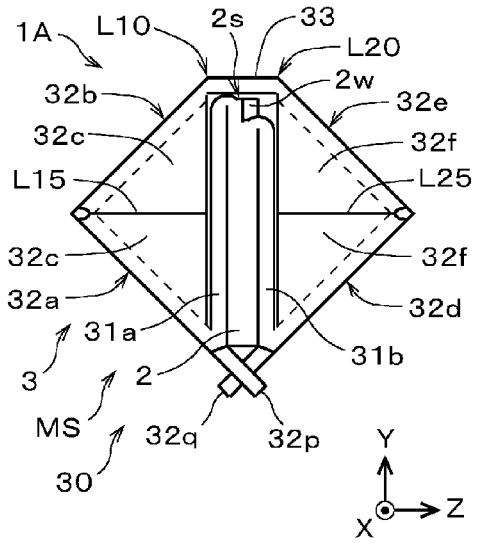

FIGS. 4A, 4B, 5A, 5B, 6A and 6B are views for explaining the transformational operation of the writing instrument 1A. FIGS. 4A and 4B and FIGS. 5A and 5B show the writing instrument 1A of the intermediate stage to transform from the flat form MF to the tridimensional form MS. FIGS. 6A and 6B show the writing instrument 1A of the tridimensional form MS. In addition, FIGS. 4A, 5A and 6A are views to see the writing instrument 1A from the −X direction. FIGS. 4B, 5B and 6B are views to see the writing instrument 1A from the +X direction.

FIGS. 4A and 4B show one example of the state in which the writing instrument 1A advances a little transformation from the flat form MF toward the tridimensional form MS (refer to FIG. 6). In the state of the early stage to become tridimensional, the mountain folds are done along the hinge lines L13, L14, L16, L23, L24 and L26 (refer to FIG. 2 and FIG. 3) and the valley folds are done along the hinge lines L15 and L25 as against the flat form MF in the foldable boarding 30. Therefore, the front roof boards 32*a* and 32*b* and the rear roof boards 32*d* and 32*e* swell outward, while the front upright board 32*c* and the rear upright board 32*f* are slightly folded inward. In addition, it is desirable to make the elastic transition to the state shown in FIGS. 4A and 4B without external force through the use of the fold habit concerning the above-mentioned mountain fold and valley fold after the release of the flat form MF, i.e., the release of the locking between the projection 32*s* and the hole 32*t* in the roof part 32.

FIGS. 5A and 5B show one example of the state in which the writing instrument 1A advances further transformation from the early stage shown in FIGS. 4A and 4B toward the tridimensional form MS. The state of the intermediate stage to become tridimensional is the state in which the front inversion board 31*a* and the rear inversion board 31*b* are folded in, for example, a direction perpendicular to the principal surface of the holder 2 to place the adjustment board 33 in such a way as to face the side surface 2*s* of the holder 2. In this stage, the front roof boards 32*a* and 32*b* and the rear roof boards 32*d* and 32*e* swell further outward, while the front upright board 32*c* and the rear upright board 32*f* are folded further inward as against the state shown in FIGS. 4A and 4B. And there is the state in which the front roof extension part 32*p* and the rear roof extension part 32*q* are prominently projected from the front inversion board 31*a* and the rear inversion board 31*b*. When the adjustment board 33 carries out further translational movement toward the side surface 2*s* of the holder 2 from the above intermediate state to become tridimensional, the foldable boarding 30 gradually covers each principal surface of the holder 2 to shift to the tridimensional form MS (refer to FIG. 6).

FIGS. 6A and 6B show the writing instrument 1A of the tridimensional form MS. In the state of the completion stage to become tridimensional, the adjustment board 33 is close to the side surface 2*s* of the holder 2 with facing it, and the front inversion board 31*a* and the rear inversion board 31*b* are inverted as against the flat form MF to make the front upright board 32*c* and the rear upright board 32*f* stand up in the direction (the Z-axis direction) perpendicular to the front inversion board 31*a* and the rear inversion board 31*b* (refer to FIG. 1). Since the convex part 2*w* (refer to FIG. 3) of the holder 2 touches (or is close to) the adjustment board 33, resulting in the increase of the area to limit the adjustment board 33 in the direction to face the side surface 2*s* of the holder 2, it is possible to stably place the adjustment board 33 in the suitable direction, i.e., the direction (the Z-axis direction) almost perpendicular to the holder 2. Moreover, the writing instrument 1A can well maintain the tridimensional form MS with the almost quadrangular prism-like outer shape by connecting the front roof extension part 32*p* to the rear roof extension part 32*q*.

In the writing instrument 1A capable of performing the above transformational operation, two end parts of the foldable boarding 30 of the twofold state shown in FIG. 2 and FIG. 3 are foldably connected to the side surface 2*s* of the holder 2 through the hinge line L11 and the hinge line L21. That is, the foldable boarding 30 is equipped with the looped structure in which one end part (portion concerning the hinge line L11) and another end part (portion concerning the hinge line L21) of the foldable boarding 30 are foldably connected to the side surface (specific side surface) 2*s* of the holder 2. In the flat form MF, the foldable boarding 30 doubled up along the farthest hinge line L10 forms a plate-like shape together with the holder 2. On the other hand, in the tridimensional form MS shown in FIGS. 6A and 6B, the foldable boarding 30 folded along the other hinge lines L11 to L16 and L20 to L26 covers both principal surfaces 2*f* and 2*g* (refer to FIGS. 2 and 3) of the holder 2 to form the prismatic penholder by moving the farthest hinge line L10 to the vicinity of the side surface 2*s* of the holder 2. Consequently, the writing instrument 1A is capable of transforming from the flat form MF to the tridimensional form MS which gives a good grip feeling.

As for the transformational operation of the writing instrument 1A, for example, when the adjustment board 33 is made to face and approach the side surface 2*s* of the holder 2 (refer to FIGS. 5A and 5B) to make the transformation part 3 transform so that it covers the holder 2 from both sides, it becomes possible to make the writing instrument 1A quickly and appropriately shift from the flat form MF to the tridimensional form MS having a comparatively complicated shape by the simple transformational action.

Moreover, by forming each board of the foldable boarding 30 from the low flexible material having small elastic deformation capability in the writing instrument 1A, the deformation of the foldable boarding 30 which is subjected to the grip force becomes small enough to perform a comfortable writing in the tridimensional form MS having the prismatic outer shape.

In the writing instrument 1A of the tridimensional form MS, the specific boards of plural boards to constitute the foldable boarding 30, specifically the front upright board 32*c* and the rear upright board 32*f* are folded with standing up with respect to each principal surface (the front principal surface 2*f* and the rear principal surface 2*g*) of the holder 2 to make the end parts of the front upright board 32*c* and the rear upright board 32*f* touch (or close to) the front inversion board 31*a* and the rear inversion board 31*b*. Thereby, the supports for sustaining the front roof boards 32*a* and 32*b* and the rear roof boards 32*d* and 32*e* in the Z-axis direction are formed. This enables to stably maintain the tridimensional form MS in a simple structure.

The foldable boarding 30 is equipped with the looped structure in which the starting point and the ending point are in the side surface 2*s* of the holder 2 of the writing instrument 1A. Therefore, even though the fold habits concerning the mountain fold or valley fold are developed along the hinge lines, the fold habits on both sides concerning the front surface AS and the back surface BS have the characteristics of almost mirror symmetry about the XY plane in the flat form MF of the twofold state although there are some position gaps. Consequently, when the projection 32*s* is locked to the hole 32*t* in the writing instrument 1A of the flat form MF as shown in FIG. 3, (the energizing forces due to) the fold habits on both sides concerning the front surface AS and the back surface BS get balanced out, and the flat state can be stably maintained with the foldable boarding 30 not bended in a specific direction.

Manufacturing Method of Writing Instrument 1A

Next, one example of the manufacturing method of the writing instrument 1A is explained.

Figure 7:
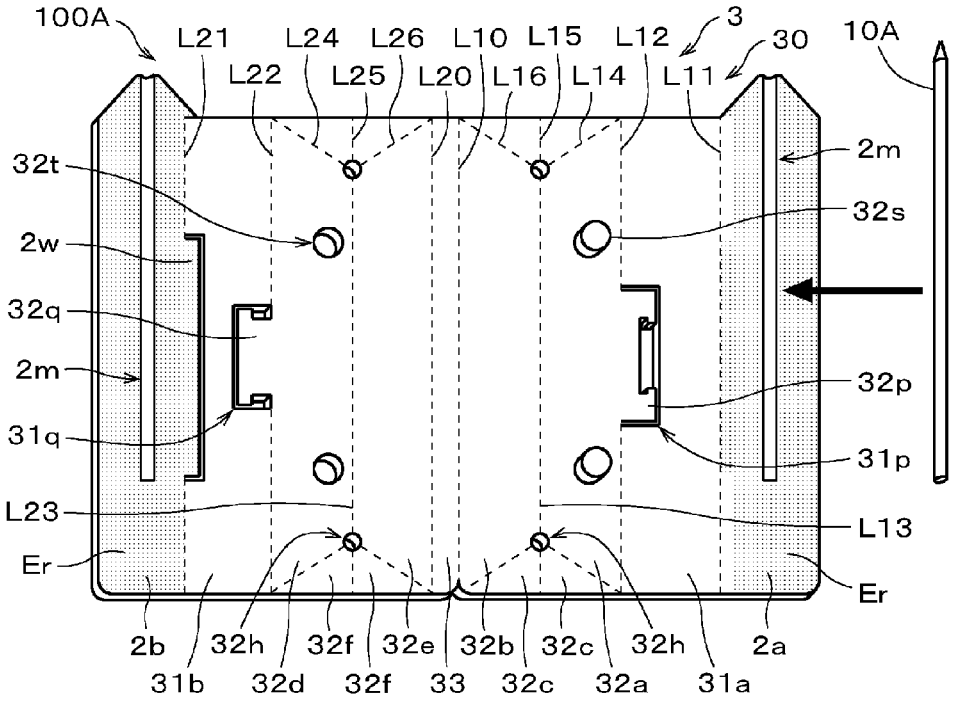
FIG. 7 is a view showing the principal construction of the component used for manufacturing the writing instrument.

First, the component 100A shown in the development view of FIG. 7 is prepared. The construction of this component 100A is explained below in detail.

The component 100A used for manufacturing the writing instrument 1A is constituted as a plate-like member having the thickness corresponding to, for example, half of the thickness of the holder 2. The component 100A is equivalent to what is obtained by making the writing instrument 1A in which the holder 2 is sliced in half along the plane (the XY plane) parallel to the principal surface to separate opened up around the hinge line L10. The front partial board 2*a* and the rear partial board 2*b* which have shapes of the front principal surface 2*f* and the rear principal surface 2*g* and between which the foldable boarding 30 planarly developed is sandwiched are provided in the both end parts of the component 100A. The plural hinge parts indicated by the hinge lines L10 to L16 and L20 to L26 are provided in the component 100A, which is constituted as a boarding capable of folding.

Next, the above component 100A is doubled up along the farthest hinge line L10. Then, the writing unit 10A is attached and held to the semicircular column-like groove portions (holding portions) 2*m* formed along the central lines of the front partial board 2*a* and the rear partial board 2*b*, and each predetermined bonding area Er (the shaded area of FIG. 7) of the front partial board 2*a* and the rear partial board 2*b* is bonded through the use of, for example, adhesive. Thereby, the writing instrument 1A is manufactured.

According to the above manufacturing method of the writing instrument 1A, the board-like component 100A in which a pair of boards (the front partial board 2*a* and the rear partial board 2*b*) corresponding to shapes of both principal surfaces 2*f* and 2*g* of the holder 2 are foldably connected to one end part (the part concerning the hinge line L11) and another end part (the part concerning the hinge line L21) of the foldable boarding 30 is provided. And the bonding areas Er in the front partial board 2*a* and the rear partial board 2*b* of the component 100A are bonded to each other to produce the holder 2. This enables to easily manufacture the writing instrument 1A. Moreover, since the writing instrument 1A is made of one component 100A and one writing unit 10A, the writing instrument 1A can be put into simple production due to extremely low parts count.

Second Preferred Embodiment

Principal Construction of Writing Instrument

Figure 8:
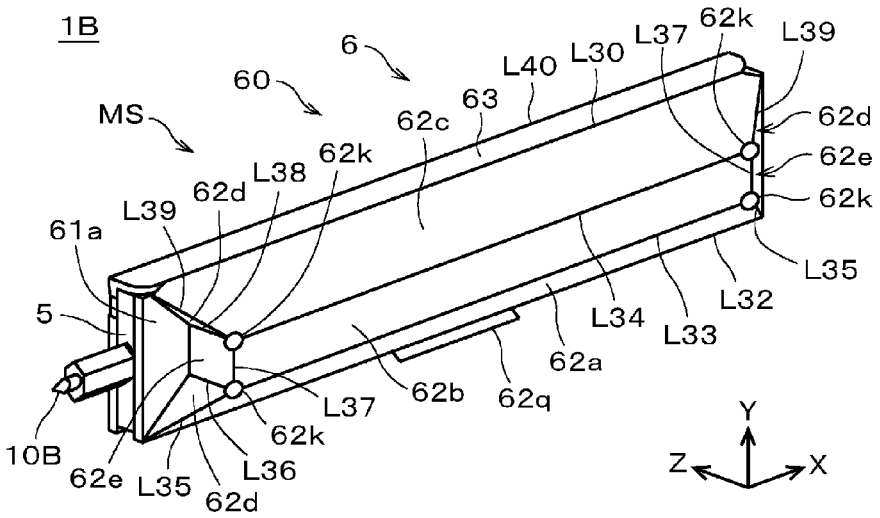
FIG. 8 is a perspective view showing the principal construction of the writing instrument concerning the second preferred embodiment of this invention.
Figure 9:
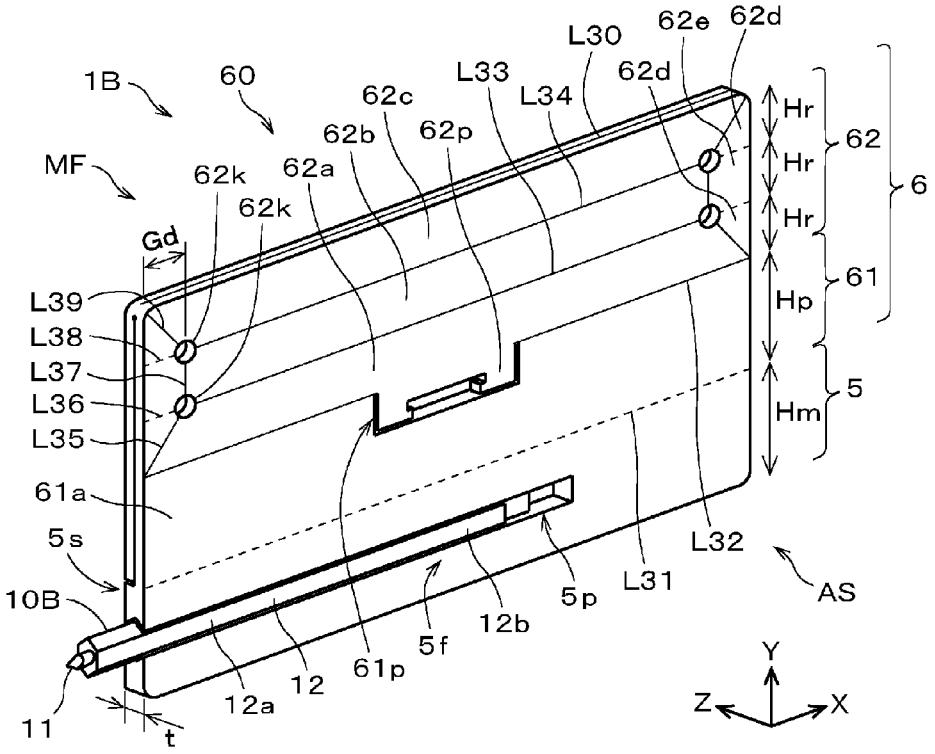
FIG. 9 and FIG. 10 are perspective views showing the appearance of the writing instrument of the flat form.
Figure 10:
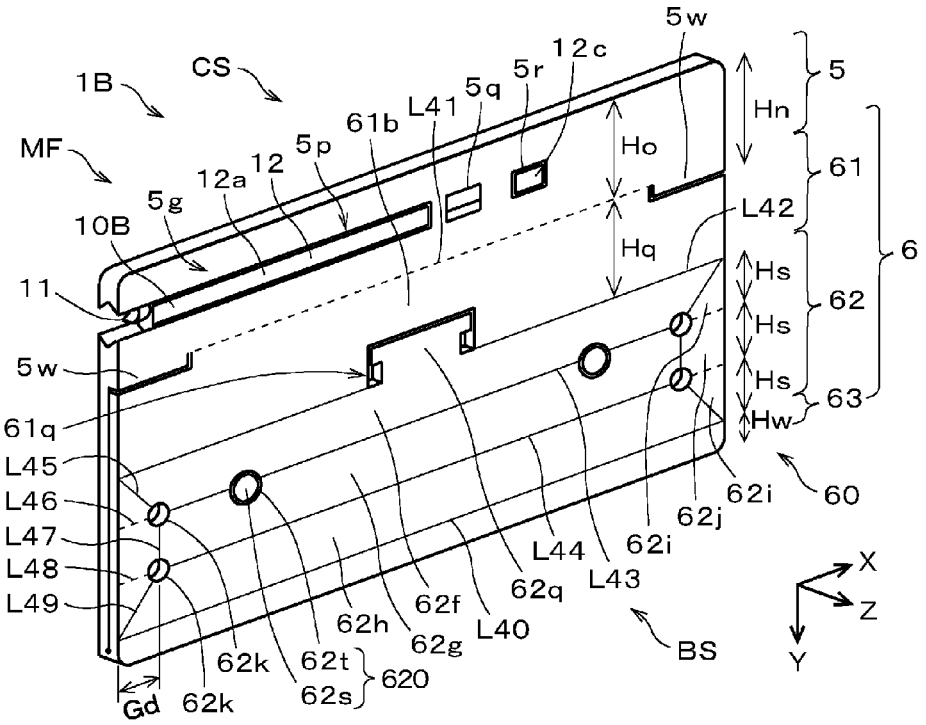

FIG. 8 is a perspective view showing the principal construction of the writing instrument 1B concerning the second preferred embodiment of this invention. FIG. 9 and FIG. 10 are perspective views showing the appearance of the writing instrument 1B of the flat form MF. FIG. 9 and FIG. 10 show the front surface AS and the back surface BS of the writing instrument 1B, and illustrate the states in which the pen nib of the writing unit 10B is projected from and retracted inside the holder 5.

As with the writing instrument 1A concerning the first preferred embodiment, the writing instrument 1B is equipped with the writing unit 10B used for writing, the holder 5 which holds the writing unit 10B, and the transformation part 6 for covering around the holder 5 in the tridimensional form MS.

Figure 14:
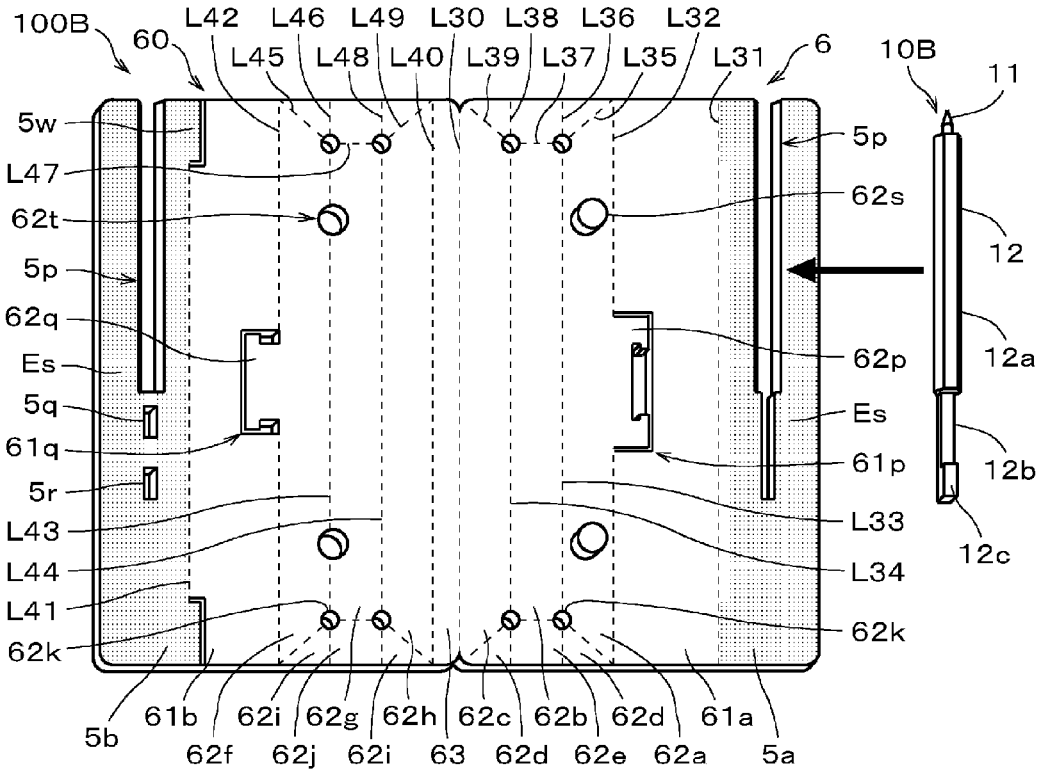
FIG. 14 is a view showing the principal construction of the component used for manufacturing the writing instrument.

As shown in FIG. 14, the writing unit 10B is equipped with the pen core 11 having the construction similar to the writing unit 10A (refer to FIG. 7) concerning the first preferred embodiment, and the holding body 12 for holding the pen core 11. The holding body 12 is equipped with the first member 12*a* which is disposed around the pen core 11 and has a hexagonal prism-like outer shape, and the second member 12*b* connected to the first member 12*a*. The second member 12*b* has a certain elasticity and a "L" character-like cross-sectional shape including the rectangle-like projecting part 12*c* in the end part. In the writing unit 10B like this, the first member 12*a* fitted into the groove portions 5*p* of the holder 5 can slide in the X-axis direction, and the projecting part 12*c* of the second member 12*b* can be selectively fitted into one of two rectangle-like holes 5*q* and 5*r* formed in the holder 5 as shown in FIG. 9 and FIG. 10. By the above construction, the pen nib of the writing unit 10B is projected from the holder 5 as shown in FIG. 9 when the projecting part 12*c* is locked to the hole 5*q*, while the pen nib is retracted inside the holder 5 as shown in FIG. 10 when the projecting part 12*c* is locked to the hole 5*r*.

As with the writing instrument 1A concerning the first preferred embodiment, the holder 5 and the transformation part 6 have a certain strength enough not to bend easily, and are formed from a material capable of tolerating repetitively folding along the hinge lines (hinge parts).

The holder 5 has a rectangular plate-like shape with the thickness t. In the holder 5, the groove portion 5*p* to enable to project and retract the writing unit 10B is formed along the central line with respect to the direction (the Y direction) of the width Hm shown in FIG. 9, and the holes 5*q* and 5*r* (refer to FIG. 10) into which the projecting part 12*c* of the writing unit 10B can fit are provided. As with the first preferred embodiment, it is desirable for the thickness t of the holder 5, in other words, the thickness of the card shape CS shown in FIG. 10 to be 2 mm or less, and more desirable for it to be 1.5 mm or less.

The front surface AS of the holder 5 has a rectangle-like shape with the width Hm. On the other hand, the back surface BS of the holder 5 has a shape in which two rectangle-like convex parts 5*w* projected from the straight line concerning the hinge line L41 are added to the rectangle-like base part having the width Ho in both sides of the end part located on the side (the side of the +Y direction) of the reversal part 61. The width Hn concerning the Y direction of the holder 5 including the convex part 5*w* is equal to the width Hm concerning the front surface AS of the holder 5. Moreover, the difference between the width Ho concerning the hinge line L41 and the width Hn concerning the convex part 5*w* in the back surface BS of the holder 5 corresponds to half of the width Hw of the below-mentioned adjustment board 63, i.e., the thickness t of the holder 5. In addition, two concave parts corresponding to the convex parts 5*w* is provided in the below-mentioned rear inversion board 61*b* (refer to FIG. 10).

The transformation part 6 is equipped with the foldable boarding 60 in which the below-mentioned boards are foldably connected through the hinge parts and which is annularly-linked to and extended from the side surface 5*s* of the holder 5. In the transformation part 6, the reversal part 61, the roof part 62 and the adjustment board 63 are provided in order of nearness from the holder 5. In addition, the thickness of each board to constitute the foldable boarding 60 corresponds to, for example, half of the thickness t of the holder 5.

The reversal part 61 is equipped with the plate-like front inversion board 61*a* and rear inversion board 61*b* which are inverted 180 degrees around the hinge line L31 and the hinge line L41 when the writing instrument 1B transforms from the flat form MF to the tridimensional form MS. The width Hp of the front inversion board 61*a* which is sandwiched between the hinge line L31 and the hinge line L32 is equal to the width Hm of the front principal surface 5*f* of the holder 5. And, the width Hq of the rear inversion board 61*b* which is sandwiched between the hinge line L41 and the hinge line L42 is equal to the width Ho of the rear principal surface 5*g* of the holder 5. This makes the hinge lines L32 and L42 located in the vicinity of the edge portion concerning the −Y direction of the holder 5 as shown in FIG. 13 when the front inversion board 61*a* and the rear inversion board 61*b* are inverted in the tridimensional form MS.

As for the front inversion board 61*a* and the rear inversion board 61*b*, the rectangle-like cutout portion 61*p* and the cutout portion 61*q* are formed in the centers of the end parts located on the side (the side of the +Y direction) of the roof part 62.

The roof part 62 is a part for shaping a trapezoid-like cross-section above the front principal surface 5*f* and the rear principal surface 5*g* of the holder 5 to form the outer shape of the penholder in the writing instrument 1B of the tridimensional form MS. The front surface AS of the roof part 62 is equipped with two trapezoid-like front roof boards 62*a* and 62*c*, one rectangle-like front roof board 62*b*, four right triangle-like front upright boards 62*d*, and two rectangle-like front upright boards 62*e* which are divided by the hinge lines L33 to L39. The back surface BS of the roof part 62 is equipped with two trapezoid-like rear roof boards 62*f* and 62*h*, one rectangle-like rear roof board 62*g*, four right triangle-like rear upright boards 62*i*, and two rectangle-like rear upright boards 62*j* which are divided by the hinge lines L43 to L49. The front roof extension part 62*p* projected from the straight line concerning the hinge line L32 in the center of the end part located on the side (the side of the −Y direction) of the reversal part 61 is provided in the front roof board 62*a*. And, the rear roof extension part 62*q* projected from the straight line concerning the hinge line L42 in the center of the end part located on the side (the side of the −Y direction) of the reversal part 61 is provided in the rear roof board 62*f*. The front roof extension part 62*p* and the rear roof extension part 62*q* have the construction similar to the first preferred embodiment and can connect to each other by the engagement between the cutout portions (refer to the cutout portions Cp and Cq shown in FIG. 2 and FIG. 3). Therefore, when the front roof extension part 62*p* is connected to the rear roof extension part 62*q*, the state in which the transformation part 6 covers the holder 5 is maintained to enable to keep the tridimensional form MS (refer to FIG. 13).

In the roof part 62, two circular holes 62*t* are formed in the back surface BS, and the cylindrical projections 62*s* capable of fitting into and locking the hole 62*t* are provided on the reverse side of the front roof board 62*a* (refer to FIG. 14) as with the first preferred embodiment. Since the projection 62*s* and the hole 62*t* like these serve as the locking part 620 to unlockably lock the interior portions of the foldable boarding 60, the flat form MF can be kept simply. That is, when the locking is performed through the use of the locking part 620 for maintaining the state in which the portions mutually facing in the foldable boarding 60 of the twofold state are close to each other, the flat form MF of the transformation part 6 (the writing instrument 1B) can be kept easily. On the other hand, when this locking is released, there becomes the state in which the transformation part 6 can become tridimensional.

In the roof part 62, the circular holes 62*k* are formed at both ends of each hinge line L33 and L34 and both ends of each hinge line L43 and L44 as with the first preferred embodiment.

As for the roof part 62, the front roof boards 62*a* to 62*c* have the equal width Hr, and the rear roof boards 62*f* to 62*h* have the equal width Hs. The width Hr concerning the front roof boards 62*a* to 62*c* is equal to the width Hs concerning the rear roof boards 62*f* to 62*h*. This width Hr (Hs) multiplied by 2 equals the width Hm of the holder 5. Each length Gd of the hinge lines L36, L38, L46 and L48 concerning the front upright boards 62*d* and 62*e* and the rear upright boards 62*i* and 62*j* (to be exact, each length of the hinge lines L36, L38, L46 and L48 extended to the points where the hinge line L35, L39, L45 and L49 and the hinge lines L37 and L47 cross) is equivalent to, for example, the width Hm (of the holder 5) multiplied by the square root of 3 and divided by 4.

By the relationship of the above widths Hm, Hr and Hs and length Gd, the roof part 62 of the tridimensional form is formed as a quadrangular prism-like shape having a similar trapezoid-like cross-section (with the relationship of mirror symmetry about the XY plane) in which the length of the lower base is double that of the upper base on each of the front principal surface 5*f* (front inversion board 61*a*) and the rear principal surface 5*g* (rear inversion board 61*b*) of the holder 5 as shown in FIG. 8.

The adjustment board 63 with a slender rectangular plate-like shape is sandwiched between the hinge line L40 and the farthest hinge line L30 which is located at the edge of the roof part 62 and is furthest from the holder 5 in the flat form MF. The adjustment board 63 is what adjusts the gap between the front and rear sides of the roof part 62 which separate along the Z direction in the tridimensional form MS (refer to FIG. 13). The adjustment board 63 has the thickness corresponding to this gap, i.e., the width Hw equal to the sum of the thickness t of the holder 5 and the thicknesses of the front inversion board 61*a* and the rear inversion board 61*b*.

The transformation part 6 having the above construction is equipped with the foldable boarding 60 consisting of the above-mentioned plural boards foldably connected through the farthest hinge line (predetermined hinge line) L30 and the other hinge lines L31 to L49. The transformation part 6 can transform between the flat form MF formed by folding along the farthest hinge line L30 and the tridimensional form MS formed by folding along the other plural hinge lines L31 to L49.

Therefore, as for the writing instrument 1B, when the valley folds are done along the hinge lines L31, L36 and L38 and the hinge lines L41, L46 and L48 (dashed line part) and the mountain folds are done along the hinge lines L32 to L35, L37 and L39 and the hinge lines L40, L42 to L45, L47 and L49 (solid line part) with respect to the planes of the papers showing FIG. 9 and FIG. 10 after the locking of the locking part 620 is released in the flat form MF, it becomes possible to transform to the tridimensional form MS (refer to FIG. 8). In addition, it is desirable to perform the processing for, for example, developing a fold habit concerning the mountain fold and valley fold in the making of the writing instrument 1B as with the first preferred embodiment. Next, the transformational operation of the writing instrument 1B is explained in detail through the use of FIGS. 11A, 11B, 12A, 12B, 13A and 13B.

Transformational Operation of Writing Instrument 1B

Figure 11A:
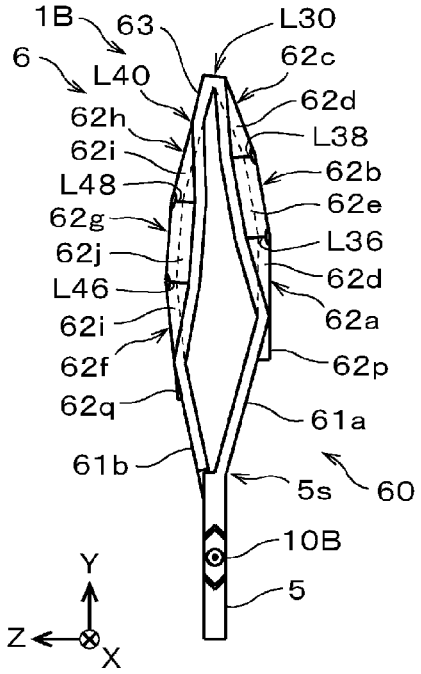
FIG. 11A and FIG. 11B are views for explaining the transformational operation of the writing instrument.
Figure 11B:
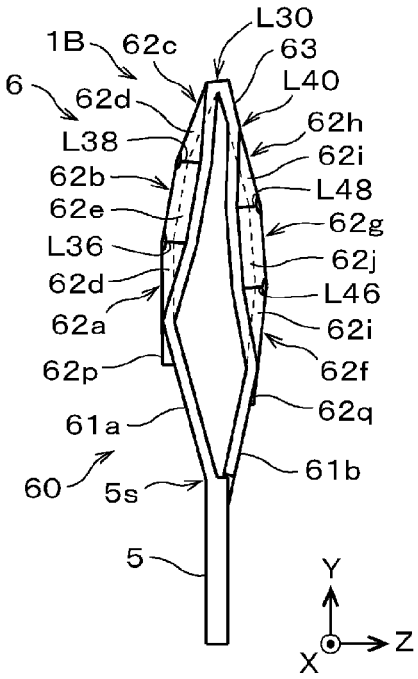
Figure 12A:
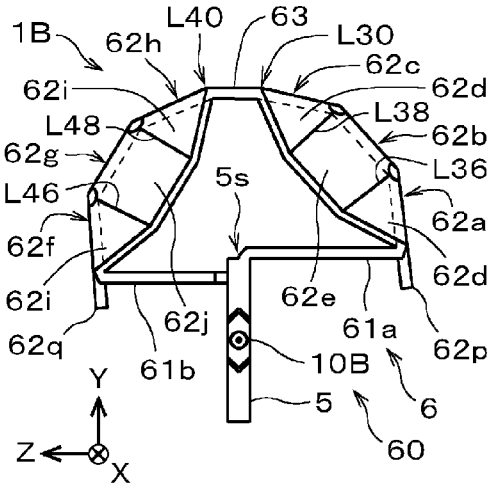
FIG. 12A and FIG. 12B are views for explaining the transformational operation of the writing instrument.
Figure 12B:
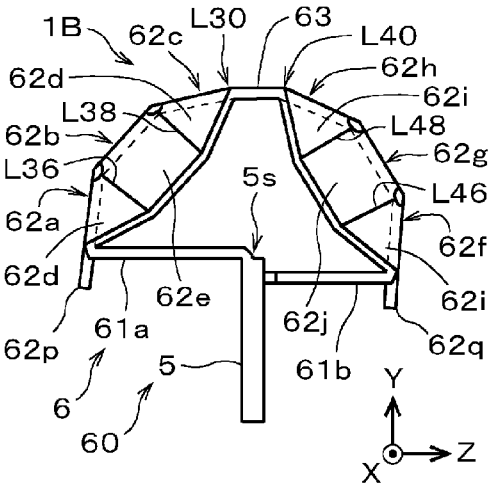
Figure 13A:
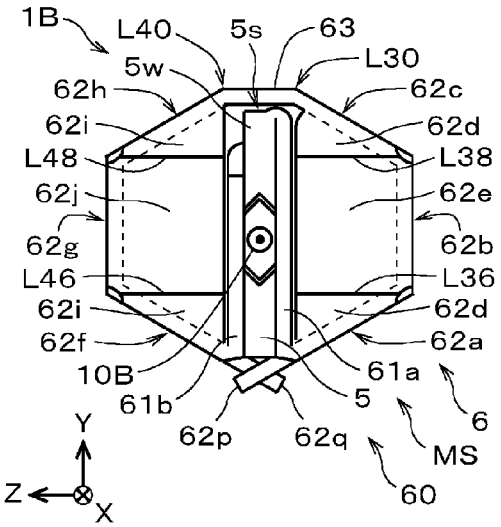
FIG. 13A and FIG. 13B are views for explaining the transformational operation of the writing instrument.
Figure 13B:
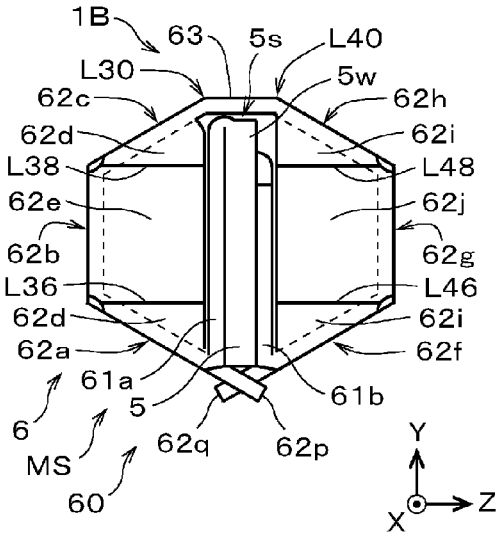

FIGS. 11A, 11B, 12A, 12B, 13A and 13B are views for explaining the transformational operation of the writing instrument 1B. FIGS. 11A and 11B and FIGS. 12A and 12B show the writing instrument 1B of the intermediate stage to transform from the flat form MF to the tridimensional form MS. FIGS. 13A and 13B show the writing instrument 1A of the tridimensional form MS. In addition, FIGS. 11A, 12A and 13A are views to see the writing instrument 1B from the −X direction. FIGS. 11B, 12B and 13B are views to see the writing instrument 1B from the +X direction.

FIGS. 11A and 11B show one example of the state in which the writing instrument 1B advances a little transformation from the flat form MF toward the tridimensional form MS (refer to FIG. 13). In the state of the early stage to become tridimensional, the mountain folds are done along the hinge lines L33 to L35, L37, L39, L43 to L45, L47 and L49 (refer to FIG. 9 and FIG. 10) and the valley folds are done along the hinge lines L36, L38, L46 and L48 as against the flat form MF in the foldable boarding 60. Therefore, the front roof boards 62*a* to 62*c* and the rear roof boards 62*f* to 62*h* swell outward, while the front upright boards 62*d* and 62*e* and the rear upright boards 62*i* and 62*j* are slightly folded inward. In addition, as with the first preferred embodiment, it is desirable to shift to the state shown in FIGS. 11A and 11B without external force through the use of the fold habit concerning the above-mentioned mountain fold and valley fold after the release of the flat form MF, i.e., the release of the locking between the projection 62*s* and the hole 62*t* in the roof part 62.

FIGS. 12A and 12B show one example of the state in which the writing instrument 1B advances further transformation from the early stage shown in FIGS. 11A and 11B toward the tridimensional form MS. The state of the intermediate stage to become tridimensional is the state in which the front inversion board 61*a* and the rear inversion board 61*b* are folded in, for example, a direction perpendicular to the principal surface of the holder 5 to place the adjustment board 63 in such a way as to face the side surface 5*s* of the holder 5. In this stage, the front roof boards 62*a* to 62*c* and the rear roof boards 62*f* to 62*h* swell further outward, while the front upright boards 32*d* and 62*e* and the rear upright boards 62*i* and 62*j* are folded further inward as against the state shown in FIGS. 11A and 11B. And there is the state in which the front roof extension part 62*p* and the rear roof extension part 62*q* are prominently projected from the front inversion board 61*a* and the rear inversion board 61*b*. When the adjustment board 63 carries out further translational movement toward the side surface 5*s* of the holder 5 from the above intermediate state to become tridimensional, the foldable boarding 60 gradually covers each principal surface of the holder 5 to shift to the tridimensional form MS (refer to FIG. 13).

FIGS. 13A and 13B show the writing instrument 1B of the tridimensional form MS. In the state of the completion stage to become tridimensional, the adjustment board 63 is close to the side surface 5*s* of the holder 5 with facing it, and the front inversion board 61*a* and the rear inversion board 61*b* are inverted as against the flat form MF to make the front upright boards 62*d* and 62*e* and the rear upright boards 62*i* and 62*j* stand up in the direction (the Z-axis direction) perpendicular to the front inversion board 61*a* and the rear inversion board

61*b* (refer to FIG. 8). As with the first preferred embodiment, since two convex parts 5*w* (refer to FIG. 10) of the holder 5 touch (or are close to) the adjustment board 63, resulting in the increase of the area to limit the adjustment board 63 in the direction to face the side surface 5*s* of the holder 5, it is possible to stably place the adjustment board 63 in the suitable direction, i.e., the direction (the Z-axis direction) almost perpendicular to the holder 5. Moreover, the writing instrument 1B can well maintain the tridimensional form MS with the almost hexagonal prism-like outer shape by connecting the front roof extension part 62*p* to the rear roof extension part 62*q*.

In the writing instrument 1B capable of performing the above transformational operation, two end parts of the foldable boarding 60 of the twofold state shown in FIG. 9 and FIG. 10 are foldably connected to the side surface 5*s* of the holder 5 through the hinge line L31 and the hinge line L41. That is, the foldable boarding 60 is equipped with the looped structure in which one end part (portion concerning the hinge line L31) and another end part (portion concerning the hinge line L41) of the foldable boarding 60 are foldably connected to the side surface (specific side surface) 5*s* of the holder 5. In the flat form MF, the foldable boarding 60 doubled up along the farthest hinge line L30 forms a plate-like shape together with the holder 5. On the other hand, in the tridimensional form MS shown in FIGS. 13A and 13B, the foldable boarding 60 folded along the other hinge lines L31 to L49 covers both principal surfaces 5*f* and 5*g* (refer to FIGS. 9 and 10) of the holder 5 to form the prismatic penholder by moving the farthest hinge line L30 to the vicinity of the side surface 5*s* of the holder 5. Consequently, the writing instrument 1B is capable of transforming from the flat form MF to the tridimensional form MS which gives a good grip feeling.

As for the transformational operation of the writing instrument 1B, for example, when the adjustment board 63 is made to face and approach the side surface 5*s* of the holder 5 (refer to FIGS. 12A and 12B) to make the transformation part 6 transform so that it covers the holder 5 from both sides, it becomes possible to make the writing instrument 1B quickly and appropriately shift from the flat form MF to the tridimensional form MS having a comparatively complicated shape by the simple transformational action.

Moreover, by forming each board of the foldable boarding 60 from the low flexible material in the writing instrument 1B, the deformation of the foldable boarding 60 which is subjected to the grip force becomes small enough to perform a comfortable writing in the tridimensional form MS having the prismatic outer shape.

In the writing instrument 1B of the tridimensional form MS, the specific boards of plural boards to constitute the foldable boarding 60, specifically the front upright boards 62*d* and 62*e* and the rear upright boards 62*i* and 62*j* are folded with standing up with respect to each principal surface (the front principal surface 5*f* and the rear principal surface 5*g*) of the holder 5 to make the end parts of the front upright boards 62*d* and 62*e* and the rear upright boards 62*i* and 62*j* touch (or close to) the front inversion board 61*a* and the rear inversion board 61*b*. Thereby, the supports for sustaining the front roof boards 62*a* to 62*c* and the rear roof boards 62*f* to 62*h* in the Z-axis direction are formed. This enables to stably maintain the tridimensional form MS in a simple structure.

The foldable boarding 60 is equipped with the looped structure in which the starting point and ending point are in the side surface 5*s* of the holder 5 of the writing instrument 1B. Therefore, even though the fold habits concerning the mountain fold or valley fold are developed along the hinge lines, the fold habits on both sides concerning the front surface AS and the back surface BS have the characteristics of almost mirror symmetry about the XY plane in the flat form MF of the twofold state although there are some position gaps. Consequently, when the projection 62*s* is locked to the hole 62*t* in the writing instrument 1B of the flat form MF as shown in FIG. 10, the fold habits on both sides concerning the front surface AS and the back surface BS get balanced out, and the flat state can be stably maintained with the foldable boarding 60 not bended in a specific direction.

In the writing instrument 1B, the construction of the transformation part 3 of the first preferred embodiment which has the quadrangular prism-like outer shape in the tridimensional form MS may be employed instead of the construction of the transformation part 6 which has the hexagonal prism-like outer shape in the tridimensional form MS. Conversely, in the writing instrument 1A of the first preferred embodiment, the construction of the transformation part 6 of the second preferred embodiment may be employed instead of the construction of the transformation part 3. Moreover, in the transformation part of each preferred embodiment, for example, a construction in which the boards located on the side of the front surface AS (or the back surface BS) in the transformation part 6 are combined with the boards located on the side of the back surface BS (or the front surface AS) in the transformation part 3 may be employed so that the pentagonal prism-like outer shape is formed in the tridimensional form.

Manufacturing Method of Writing Instrument 1B

Next, one example of the manufacturing method of the writing instrument 1B is explained.

First, the component 100B shown in the development view of FIG. 14 is prepared. The construction of this component 100B is explained below in detail.

The component 100B used for manufacturing the writing instrument 1B is constituted as a plate-like member having the thickness corresponding to, for example, half of the thickness of the holder 5. The component 100B is equivalent to what is obtained by making the writing instrument 1B in which the holder 5 is sliced in half along the plane (the XY plane) parallel to the principal surface to separate opened up around the hinge line L30. The front partial board 5*a* and the rear partial board 5*b* which have shapes of the front principal surface 5*f* and the rear principal surface 5*g* and between which the foldable boarding 60 planarly developed is sandwiched are provided in the both end parts of the component 100B. The plural hinge parts indicated by the hinge lines L30 to L49 are provided in the component 100B, which is constituted as a boarding capable of folding.

The groove portions 5*p* which slidably hold the writing unit 10B and have the trapezoid-like cross-section are formed along each central line of the front partial board 5*a* and the rear partial board 5*b*. The rectangle-like holes 5*q* and 5*r* into which the projecting part 12*c* of the writing unit 10B can fit are provided in the rear partial board 5*b*.

Next, the above component 100B is doubled up along the farthest hinge line L30. Then, the writing unit 10B is attached and held to the groove portions (holding portions) 5*p* formed in the front partial board 5*a* and the rear partial board 5*b*, and each predetermined bonding area Es (the shaded area of FIG. 14) of the front partial board 5*a* and the rear partial board 5*b* is bonded through the use of, for example, adhesive. Thereby, the writing instrument 1B is manufactured.

According to the above manufacturing method of the writing instrument 1B, the board-like component 100B in which a pair of boards (the front partial board 5*a* and the rear partial board 5*b*) corresponding to shapes of both principal surfaces 5*f* and 5*g* of the holder 5 are foldably connected to one end part (the part concerning the hinge line L31) and another end part (the part concerning the hinge line L41) of the foldable boarding 60 is provided. And the bonding areas Es in the front partial board 5*a* and the rear partial board 5*b* of the component 100B are bonded to each other to produce the holder 5. This enables to easily manufacture the writing instrument 1B. Moreover, since the writing instrument 1B is made of one component 100B and one writing unit 10B, the writing instrument 1B can be put into simple production due to extremely low parts count.

Modification

In the above-mentioned first preferred embodiment, it is not indispensable to provide the front upright board 32*c* and the rear upright board 32*f*. The construction in which these are not provided may be employed. This construction is explained below through the use of FIG. 15 and FIGS. 16A and 16B.

Figure 15:
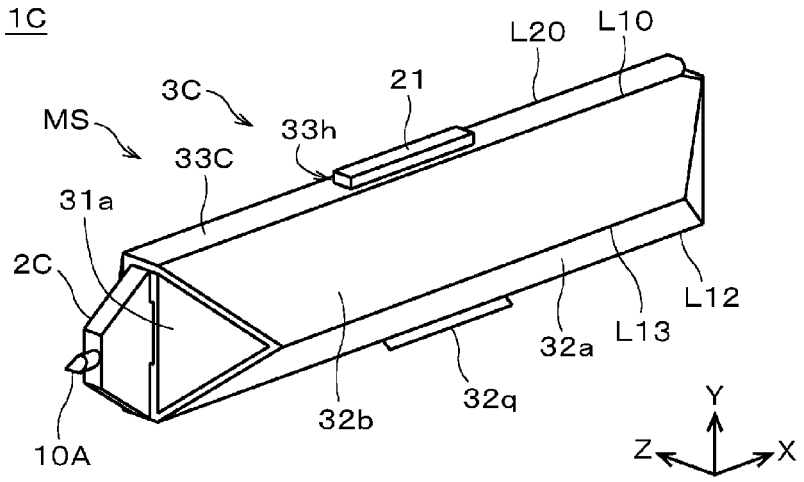
FIG. 15 is a view for explaining the construction of the writing instrument concerning the modification of this invention.
Figure 16A:
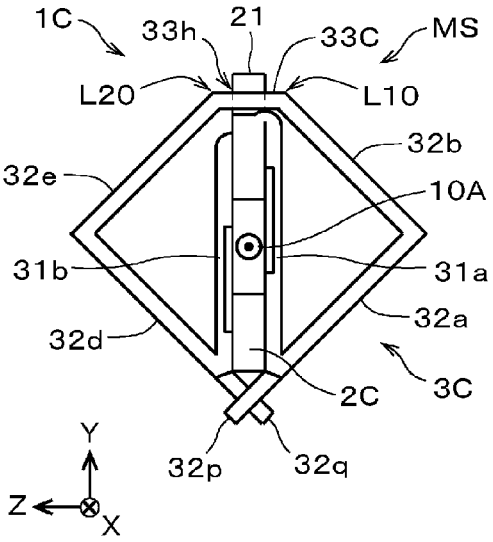
FIG. 16A and FIG. 16B are views for explaining the construction of the writing instrument.
Figure 16B:
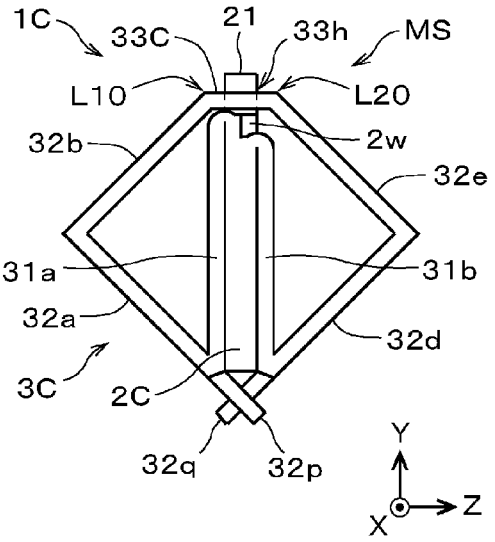

FIG. 15 and FIGS. 16A and 16B are views for explaining the construction of the writing instrument 1C concerning the modification of this invention. FIG. 15 and FIGS. 16A and 16B correspond to FIG. 1 and FIGS. 6A and 6B showing the writing instrument 1A of the first preferred embodiment.

The writing instrument 1C is equipped with the transformation part 3C in which the front upright board 32*c* and the rear upright board 32*f* are omitted from the transformation part 3 of the first preferred embodiment. By omitting the front upright board 32*c* and the rear upright board 32*f*, the holes 32*h* provided in the first preferred embodiment become unnecessary for the transformation part 3C.

On the other hand, the writing instrument 1C has the holder 2C in which the rectangular parallelepiped-like convex part 21 projected in the +Y direction is added as against the holder 2 of the first preferred embodiment. The slit (opening part) 33*h* which the convex part 21 is inserted into and locked to is provided in the adjustment board 33C of the transformation part 3C.

The above writing instrument 1C is equipped with the construction for enabling to unlockably lock the convex part 21 of the holder 2C to the slit 33*h* of the transformation part 3C. Therefore, even though the front upright board 32*c* and the rear upright board 32*f* of the first preferred embodiment are not provided, it is possible for the front roof boards 32*a* and 32*b* and the rear roof boards 32*d* and 32*e* to keep the gable roof-like form as with the first preferred embodiment by engaging and locking the convex part 21 to the slit 33*h* and connecting the front roof extension part 32*p* to the rear roof extension part 32*q*. This enables the transformation part 3C (the writing instrument 1C) to keep the tridimensional form MS with the quadrangular prism-like shape.

In the above-mentioned first preferred embodiment, it is not indispensable to employ the holder 2 having the principal surface constituted as an even surface such as the front principal surface 2*f* or the rear principal surface 2*g*. The holder having the principal surface in which the portion for holding the writing unit 10A is raised may be employed. The construction of this holder is explained below through the use of FIGS. 17A and 17B.

Figure 17A:
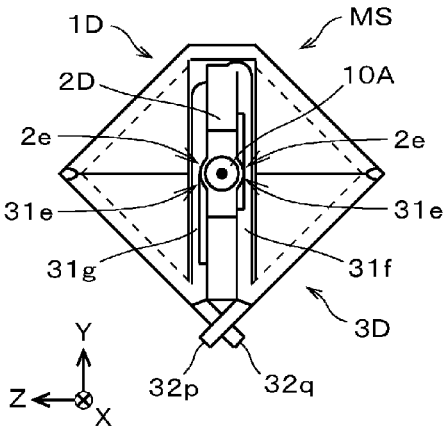
FIG. 17A and FIG. 17B are views for explaining the construction of the writing instrument concerning the other modification.
Figure 17B:
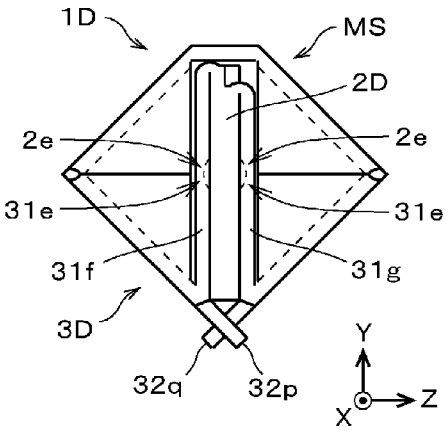

FIG. 17A and FIG. 17B are views for explaining the construction of the writing instrument 1D concerning the other modification. FIG. 17A and FIG. 17B correspond to FIG. 6A and FIG. 6B showing the writing instrument 1A of the first preferred embodiment.

The writing instrument 1D is equipped with the holder 2D having the raised portion 2*e* in which the area for holding the writing unit 10A is raised. The depressed portions 31*e* to fit into the shape of the raised portion 2*e* are provided in the front inversion board 31*f* and the rear inversion board 31*g* of the transformation part 3D. By the construction like this, in the writing instrument 1D of the tridimensional form MS, the front inversion board 31*f* and the rear inversion board 31*g* appropriately fit and touch the principal surfaces of the holder 2D having the raised portion 2*e* to enable to stably maintain the tridimensional form MS.

In addition, the construction of the writing instrument 1D may be applied to the writing instrument 1B of the second preferred embodiment. In this case, the writing unit 10B is protruded and raised from the surface of the holder 5. However, when the above depressed portions are formed in the front inversion board 61*a* and the rear inversion board 61*b*, the tridimensional form MS can be stably maintained.

Figure 18:
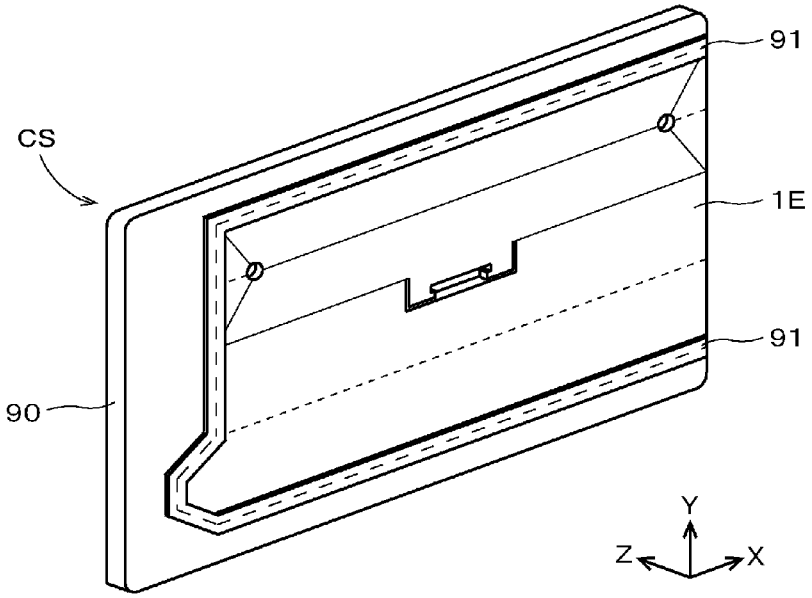
FIG. 18 is a view for explaining the accessory concerning the other modification.

In the above-mentioned first preferred embodiment, it is not indispensable to employ the accessory 9 to be connected to the end part of one direction (the −X direction) concerning the writing instrument 1A. The accessory to be connected to the writing instrument with surrounding two or three directions of it may be employed. In the case of the three directions, for example, as shown in FIG. 18, the accessory 90 holds the writing instrument 1E slightly downsized from the writing instrument 1A of the first preferred embodiment between the parts 91 protruded along upper and lower edges of the three directions (the −X direction and the ±Y directions). In addition, it is desirable for the size of the accessory 90 to house the writing instrument 1E to be a business card size.

In each above-mentioned preferred embodiment, it is not indispensable to employ a core of a ballpoint pen as the writing unit. A pencil lead, a core (a pen nib and an ink reservoir) of a marker, or a mechanical pencil etc. may be employed.

In each above-mentioned preferred embodiment, it is not indispensable to maintain the state in which the portions mutually facing in the foldable boarding 30 (60) of the two-fold state are close to each other by the mechanical retention using the locking part 320 (620). The flat form of the foldable boarding may be maintained by using magnetic force. Concretely, a permanent magnet is disposed in one of the inner (inside) portions facing each other in the foldable boarding, and a magnetic material such as a permanent magnet or iron is disposed in another. By the construction like this, it becomes possible to appropriately keep the flat form of the foldable boarding through the use of magnetic attraction.

In each above-mentioned preferred embodiment, it is not indispensable for the front upright boards 32*c* (62*d* and 62*e*) and the rear upright boards 32*f* (62*i* and 62*j*) to stand up in the direction exactly perpendicular to the principal surface of the holder. The front and rear upright boards may stand up in the direction somewhat inclined from the perpendicular direction. Moreover, it is not indispensable for the upright boards to stand up in two places (the vicinity of the pen nib, and the back end of the pen). It is only necessary for them to stand up in at least one place.

In each above-mentioned preferred embodiment, it is not indispensable to employ the hinge part (the hinge line) which develops a fold habit in order to guide the intended folding direction (the direction concerning either the mountain fold or the valley fold). The hinge part not to easily fold in the direction opposite to the intended folding direction by, for example, making a sharp cut from one direction along the thickness direction of the board may be employed. Moreover, in each above-mentioned preferred embodiment, it is not indispensable that the holes 32*h* or the holes 62*k* are provided at the points to connect the mountain fold hinge lines to the valley fold hinge lines. The holes 32*h* or 62*k* may be unprovided.

In each above-mentioned preferred embodiment, it is not indispensable to hold the writing unit 10A (10B) in the vicinity of the central line with respect to the direction of the width Ha (Hm) of holder 2 (5) as shown in FIG. 2 or FIG. 9. It may be held in the place distant from the central line.

In each above-mentioned preferred embodiment, it is not indispensable to provide two pairs of the projections 32*s* (62*s*) and the holes 32*t* (62*t*) as the locking part. Only one pair may be provided, and three pairs or more may be provided.

In the above-mentioned first preferred embodiment, it is not indispensable for the roof part 32 of the tridimensional form on each principal surface of the holder 2 to have the isosceles right triangle-like cross-section. It may have the other triangle-like cross-section. Similarly, in the above-mentioned second preferred embodiment, it is not indispensable for the roof part 62 of the tridimensional form on each principal surface of the holder 5 have the cross-section of the trapezoid-like shape in which the length of the lower base is double that of the upper base. It may have the cross-section of the other quadrangular shape.

As for the manufacturing method of the writing instrument 1A concerning the above-mentioned first preferred embodiment, it is not indispensable to form the groove portions (holding portions) 2*m* in both the front partial board 2*a* and the rear partial board 2*b* concerning the component 100A. The groove portion 2*m* may be formed in either the front partial board 2*a* or the rear partial board 2*b*. Moreover, as for the manufacturing method of the writing instrument 1A, it is not indispensable to attach the writing unit 10A to the groove portions 2*m* at the time of the bond between the front partial board 2*a* and the rear partial board 2*b*. The writing unit 10A may be preliminarily attached to the groove portion 2*m* of the front partial board 2*a* or the rear partial board 2*b* before the bond. The writing unit 10A may be inserted and attached to the groove portions 2*m* which form the cylindrical hole after the bond.

As for the manufacturing method of the writing instrument concerning each above-mentioned preferred embodiment, it is not indispensable to bond the entire area of the area Er or Es (the shaded area shown in FIG. 7 or FIG. 14) in the front partial board and the rear partial board. One part of the area Er or Es may be bonded.

As for the manufacturing method of the writing instrument concerning each above-mentioned preferred embodiment, it is not indispensable to provide the component 100A (100B) to produce. The components corresponding to the holder and the foldable boarding may be provided to couple each other.

While the invention has been shown and described in detail, the foregoing description is in all aspects illustrative and not restrictive. It is therefore understood that numerous modifications and variations can be devised without departing from the scope of the invention.

What is claimed is:

1. A writing instrument which is equipped with a writing unit, comprising:

a holder which holds said writing unit and has a flat shape; and a transformation part which is capable of transforming between a flat form and a tridimensional form and is equipped with a foldable boarding including a plurality of boards foldably connected through a predetermined hinge part and other hinge parts, wherein;

regardless of being in said flat form or said tridimensional form, said foldable boarding is equipped with a looped structure in which one end part and another end part of said foldable boarding are foldably connected to a specific side surface of said holder;

said foldable boarding which is folded in two along said predetermined hinge part forms a flat shape together with said holder in said flat form; and said foldable boarding which is folded along said other hinge parts covers both principal surfaces of said holder to form a prismatic penholder in said tridimensional form by moving said predetermined hinge part to a vicinity of said specific side surface.

2. The writing instrument according to claim 1, wherein in said tridimensional form, specific boards of said plurality of boards are perpendicular to said holder.

* * * * *